US007916092B2

(12) United States Patent
Homan et al.

(10) Patent No.: US 7,916,092 B2
(45) Date of Patent: Mar. 29, 2011

(54) FLEXIBLE CIRCUIT FOR DOWNHOLE ANTENNA

(75) Inventors: Dean M. Homan, Sugar Land, TX (US); Mark T. Frey, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 624 days.

(21) Appl. No.: 11/461,923

(22) Filed: Aug. 2, 2006

(65) Prior Publication Data

US 2008/0030415 A1 Feb. 7, 2008

(51) Int. Cl.
*H01Q 1/04* (2006.01)

(52) U.S. Cl. ..... 343/719; 343/895; 343/787

(58) Field of Classification Search ..... 343/895, 343/719, 787, 788, 866, 867
See application file for complete search history.

(56) References Cited

U.S. PATENT DOCUMENTS

| | | | | |
|---|---|---|---|---|
| 4,319,191 | A | 3/1982 | Meador et al. | |
| 5,115,198 | A | 5/1992 | Gianzero et al. | |
| 5,508,616 | A | 4/1996 | Sato et al. | |
| 5,602,557 | A | 2/1997 | Duerr | |
| 5,781,436 | A | 7/1998 | Forgang et al. | |
| 6,452,569 | B1 * | 9/2002 | Park et al. | 343/895 |
| 6,690,170 | B2 | 2/2004 | Homan et al. | |
| 7,508,350 | B2 * | 3/2009 | Hein et al. | 343/787 |
| 2002/0047812 | A1 * | 4/2002 | Otomo et al. | 343/895 |
| 2002/0089453 | A1 * | 7/2002 | Tseng et al. | 343/702 |
| 2003/0184488 | A1 * | 10/2003 | Smith et al. | 343/787 |
| 2005/0189945 | A1 * | 9/2005 | Reiderman | 324/333 |
| 2006/0103585 | A1 * | 5/2006 | Martin | 343/895 |

FOREIGN PATENT DOCUMENTS

| | | |
|---|---|---|
| WO | WO9800733 | 1/1998 |

* cited by examiner

*Primary Examiner* — Douglas W Owens
*Assistant Examiner* — Dieu Hien T Duong
(74) *Attorney, Agent, or Firm* — Darla Fonseca; Charlotte Rutherford

(57) ABSTRACT

An antenna for an electromagnetic tool having a longitudinal axis and a core. The antenna includes a flexible dielectric substrate flexibly conformed about the core and an electrical conductor disposed on the dielectric substrate. The electrical conductor is disposed on the substrate such that the antenna has a dipole moment having any desired direction relative to the longitudinal axis of the tool.

4 Claims, 11 Drawing Sheets

1100

FLEXIBLE CIRCUIT FOR DOWNHOLE ANTENNA

BACKGROUND OF THE INVENTION

1. Field of the Invention

The present invention relates generally to an electromagnetic-based measurement apparatus and method used in well logging. More particularly, the invention relates to antenna structures for such an electromagnetic (EM) measurement apparatus.

2. Background Art

Electromagnetic-based tools or instruments for measuring properties of matter or identifying its composition are well known. For example, resistivity measurements and nuclear magnetic resonance (NMR) measurements are commonly used to infer characteristics of earth formations. The values of electrical conductivity for earth formations have been obtained through the use of EM propagation and induction tools. EM propagation well logging devices are used to measure basic parameters, such as amplitude and phase shift of EM waves that propagate through a medium and, thereby to determine specific properties of the medium.

Electrical conductivity (or its inverse, resistivity) is an important property of subsurface formations in geological surveys and in prospecting for oil, gas, and water because many minerals, and more particularly hydrocarbons, are less conductive than the water filling the pores of sedimentary rocks. Thus, a measure of the conductivity is often a guide to the presence and amount of oil, gas, or water.

EM propagation logging instruments generally use multiple longitudinally-spaced transmitter antennas operating at one or more frequencies and a plurality of longitudinally spaced receiver pairs. An EM wave is propagated from the transmitter antenna into the formation in the vicinity of the borehole and is detected at the receiver antenna(s). A plurality of parameters of interest can be determined by combining the basic measurements of phase and amplitude. Such parameters include the resistivity, dielectric constant, and porosity of the formation, as well as, for example, the degree to which the fluid within the borehole has migrated into the earth formation.

When a time-varying electric current is applied to a transmitter antenna on an induction logging instrument, a time-varying magnetic field is generated. The time-varying magnetic field induces eddy currents in the surrounding earth formations. The eddy currents induce voltage signals in the receiver antennas, which are then measured. The magnitude of the induced voltage signals varies in accordance with the formation properties. In this manner, certain formation properties may be determined.

Conventional antennas used in EM propagation or induction tools consist of coils (or toroids) mounted on the instruments with their axes parallel to the instrument's central or longitudinal axis. Accordingly, the induced magnetic (or electric) field is also substantially parallel to the central axis of the tool and the corresponding induced eddy currents make up loops lying in planes perpendicular to the tool axis.

The response of the described induction logging instrument, when analyzing stratified earth formations, strongly depends on the conductive layers parallel to the eddy currents. Nonconductive layers located within the conductive layers will not contribute substantially to the response signal and therefore their contributions will be masked by the conductive layers' response. Accordingly, in such geometries the nonconductive layers are not accurately detected by typical induction logging instruments.

Many earth formations consist of conductive layers with non-conductive layers interleaved between them. The non-conductive layers contain, for example, hydrocarbons disposed in the particular layer. Thus, conventional lodging instruments are of limited use for the analysis of stratified formations. One way to get past this problem is to use a tool having at least one coil or toroid having its axis tilted or transverse to the longitude axis of the tool.

Solutions have been proposed to detect nonconductive layers located within conductive layers. U.S. Pat. No. 5,781,436 described a method that consists of selectively passing an alternative current through transmitter coils inserted into the well with at least one coil having its axis oriented differently form the axis orientation of the other transmitter coils.

The coil arrangement shown in U.S. Pat. No. 5,781,436 consists of several transmitter coils with their centers distributed at different locations along the instrument and with their axes in different orientations. Several coils have the usual orientation, i.e., with their axes parallel to the instrument axis and, therefore, to the well axis. Others have their axes perpendicular to the instrument axis. This latter arrangement is usually referred to as a transverse coil configuration.

Thus, transverse EM logging tools use antennas whose magnetic or electric moment is transverse to the well's longitudinal axis. The magnetic moment M of a coil or solenoid-type antenna is represented as a vector quantity oriented parallel to the induced magnetic field, that is, perpendicular to the effective plane of the solenoid, with its magnitude proportional to the corresponding magnetic flux. In a first approximation, a coil with a magnetic moment M can be seen as a magnetic dipole antenna. The electric moment P of a toroidal-type antenna is represented as a vector quantity oriented parallel to the induced electric field.

In some applications, it is desirable for a plurality of magnetic or electric moments to have a common intersection, but with different orientations. For example, dipole antennas could be arranged such that their moments point along mutually orthogonal directions. An arrangement of a plurality of dipole antenna wherein the induced moments are oriented orthogonally in three different directions is referred to as a triaxial orthogonal set of dipole antennas.

A logging instrument equipped with an orthogonal set of dipole antennas offers advantages over an arrangement that uses standard dipole antennas distributed at different axial positions along the instrument with their axes in different orientations, such as proposed in U.S. Pat. No. 5,781,436. However, it is not convenient to build orthogonal dipole antennas with conventional solenoid coils or toroids due to the relatively small diameters required for logging instruments. Arrangements consisting of, for example, solenoid coils with their axes perpendicular to the well's central axis occupy a considerable amount of space within the logging instrument.

In addition to the transmitter coils and the receiver coils, it is also generally necessary to equip the induction logging instrument with "bucking" coils in which the magnetic field induces an electric current in the bucking coils that is opposite and equal in magnitude to the current that is induced in the receiver coil when the instrument is disposed within a non-conducting medium such as, for example, air. Bucking coils can be connected in series either to the transmitter or the receiver coil. For a bucking coil with a fixed number of turns, the reciver's output is set to zero by varying the axial distance between the transmitter or receiver coil and the bucking coil. This calibration method is usually known as mutual balancing.

Transverse magnetic fields are also useful for the implementation of NMR based methods. U.S. Pat. No. 5,602,557, for example, describes an arrangement that has a pair of conductor loops, each of which is formed by two saddle-shaped loops lying opposite one another and rotationally offset 90° relative to one another.

An emerging technique in the filed of well logging is the use of tools incorporating tilted coils, i.e., where the coils are tilted with respect to the tool axis. These apparata are configured as such in an effort to alter the direction of the downhole measurement. U.S. Pat. No. 5,508,616 describes an induction tool incorporating tilted transmitter and receiver coils. PCT Application WO 98/00733. Bear et al., describes a logging tool including triaxial transmitter and receiver coils. U.S. Pat. No. 4,319,191 describes a logging tool incorporating transversely aligned transmitter and receiver coils. U.S. Pat. No. 5,115,198 described a tool including a triaxial receiver coil for measuring formation properties. U.S. Pat. No. 5,757,191 describes a method and system for detecting formation properties with a tool including triaxial coils.

The prior art antennas referred to above require winding a coil or toroid. Conventional methods to wind these inductors use wire, but those methods are neither efficient nor reproducible. This is because the tension in the wire and the exact placement of the wire cannot be well controlled. To alleviate those problems, flexible circuit boards have been contemplated for application in a multi-axial antenna design. U.S. Pat. No. 6,690,170 describes copper traces that are mounted on a flexible printed circuit board made of an insulating material to allow the coil or set of coils to be placed on top of an underlying wire-wound axial coil. The transverse saddle coils of the flexible printed circuit board contain four planar rectangular or circular coils of N turns separated from the wire-wound axial coil by the insulating material of the circuit board. When conformed around a non-conducting cylinder, opposite pairs, of planar trances form a transverse coil. One pair has a magnetic dipole moment in the x-direction and the other pair's magnetic dipole moment is in the y-direction. The underlying wire-wound coil is an axial coil having a magnetic dipole moment in the z-direction of the triaxial antenna configuration. These flexible circuit transverse coils have been integral to designing a co-located antenna tool, but do not address the challenges associated with tilted and axial coil or toroid designs.

SUMMARY OF INVENTION

The present application is directed to an antenna for an electromagnetic tool having a longitudinal axis and a core. The antenna includes a flexible dielectric substrate flexibly conformed about the core and an electrical conductor disposed on the dielectric substrate. The electrical conductor is disposed on the substrate such that the antenna has a dipole moment having any desired direction relative to the longitudinal axis of the tool.

DETAILED DESCRIPTION

The present invention relates generally to an electromagnetic well logging apparatus. More particularly, the invention relates to antennas incorporating a flexible circuit design, a method of obtaining wellbore measurements using such antennas, and/or a method of constructing such antennas. Thee illustrations of exemplary embodiments are provided to facilitate a detailed description of the invention as well as to reveal a best mode of practicing the invention. It will be apparent to one skilled in the geophysical, electro-mechanical, and other relevant arts, however, that the invention is applicable to wireline measurement techniques, MWD techniques, surface measuring techniques, and other techniques for obtaining measurements of a geological formation. Various aspects may also be applicable to measurements of other formations or bodies that involve the use of antennas. Accordingly, the invention should not be limited to the specific structures, processes, steps, and objects described herein, which are provided for exemplary purposes.

Figure 1:
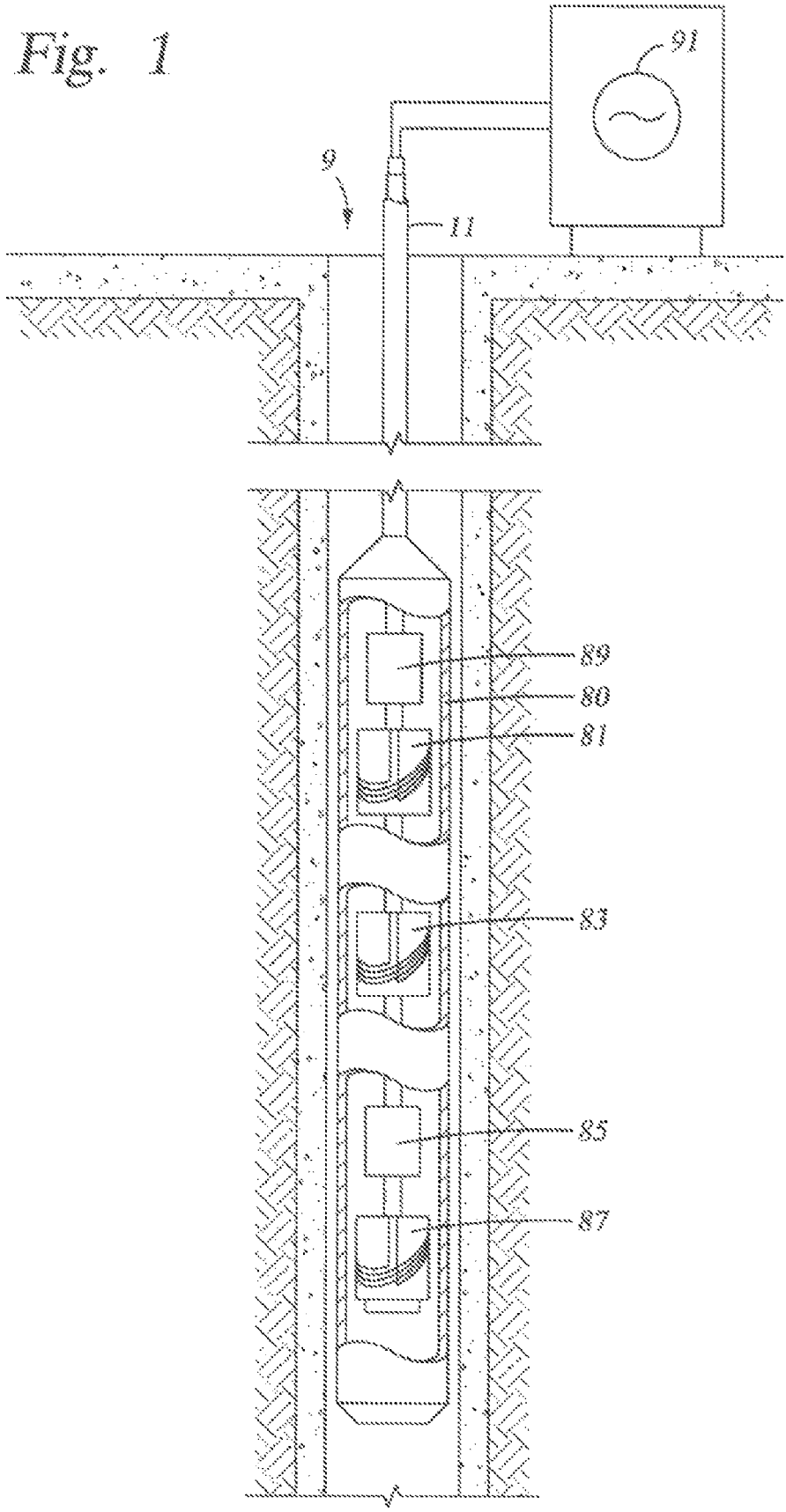
FIG. 1 is a schematic diagram of a logging tool implementation in accord with the invention.

FIG. 1 shows a logging tool 80, according to one embodiment of the invention, disposed within a well on a wireline 11. The tool 80 has a transmitter antenna 81, a bucking antenna 83, used a receiver antenna 87. The bucking antenna 83 can be connected in inverse polarity to either the transmitter antenna 81 or to the receiver antenna 87. Transmitter electronic circuitry 89 is connected to the transmitter antenna 81 to provide time-varying electric currents to induce time-varying magnetic fields. Power supply 91 feeds the circuitry 89. Receiver circuitry 85 is connected to the receiver antenna 83 to detect and measure resulting EM signals. While the antennas shown in FIG. 1 are tilted coils, the invention is not limited to that type of antenna. Also, if the logging tool 80 is a propagation logging tool, no bucking antenna 83 is required.

Figure 2:
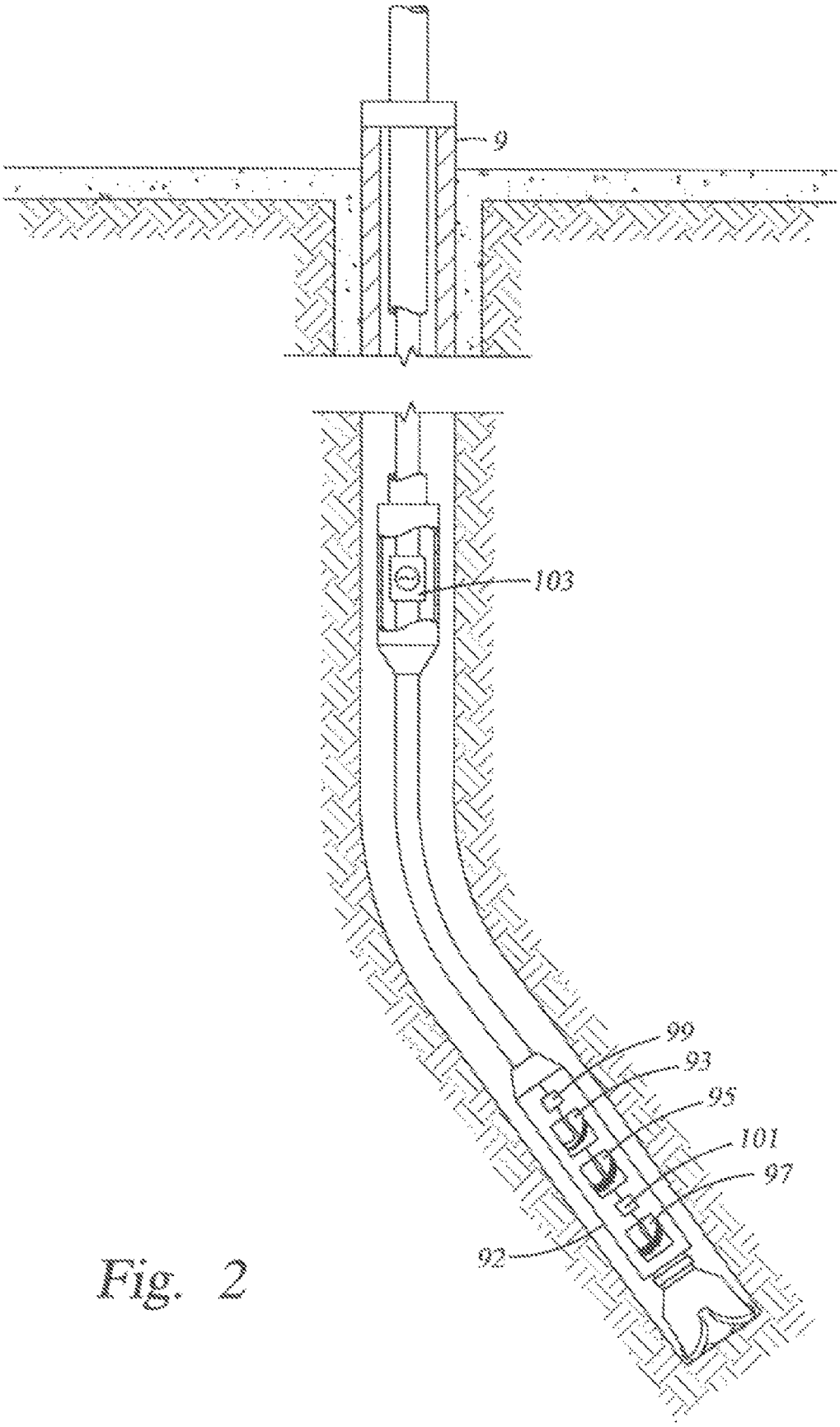
FIG. 2 is a schematic diagram of another lodging tool implementation in accord with the invention.

FIG. 2 shows a drilling tool 92 disposed in a well 9 according to one embodiment of the invention. The drilling tool 92 has a transmitter antenna 93, a bucking antenna 95, and a receiver antenna 97. The bucking antenna 95 can be connected with an inverse polarity to either the transmitter antenna 93 or to the receiver antenna 97. The transmitter electronic circuitry 99 is connected to the transmitter antenna 93 to provide time-varying electric currents to induct time-varying magnetic fields. Power supply 103 feeds the circuitry 99. Receiver circuitry 101 is connected to the receiver antenna 97 to detect and measure resulting EM signals. Similar to that stated above, although the antennas shown in FIG. 2 are tilted coils, the invention is not limited to that type of antenna. Also, if the drilling tool 92 is a propagation logging tool, no bucking antenna 95 is required.

Those skilled in the art will appreciate that the antenna apparatus of the invention are not limited to use in any one particular type of measurement or exploration operation and that they may be disposed within a well bore on any type of support member, e.g., on coiled tubing, drill collars, or wireline tools.

The focus of the present application is a description of an antenna structure, wherein axial or tiled coils and toroids are provided in or by flexible dielectric substrates (i.e., flexible circuit boards), according to the present invention. As shown herein, certain structural attributes of flexible circuit boards are particularly advantageous in axial and tilted antenna constructions and related measuring techniques. The flexible circuit boards according to a present invention method of construction may be flexibly conformed about the peripheral surface of a downhole measurement tool and the like.

Axial and Tilted Coil Embodiments

Conventional construction of axial and tilted coils requires wrapping a conductive, insulated magnet wire around a bobbin. This construction process may create non-reproducible features such as variable impedances due to coil wiring geometry. The root cause of this variability is variances in the wire tension and in the placement of the wire during production. The coil impedance is also affected when coils are coated with a varnish, which causes the wires to move as a result of thermal effects arising from the downhole environment. Wire movement is even more pronounced if the coil is wrapped with multiple layers. When fabricating tilted coils, the magnetic wire may have to be laid into machined groves. As a result, limitations are placed on the minimum wire density by the tooling capability of machining equipment such as a five-axis lathe.

Construction of an axial or tilted coil or antenna utilizing a flexible circuit board provide certain engineering and performance benefits. Many of these benefits are derived from an ability to better control certain physical variables of the flexible circuit board that drive or affect the performance of the coil or antenna (i.e., the properties of the coil).

To illustrate, the magnetic moment of an axial coil having a circular cross section is defined as $$M_{axial}=\pi r^2 NI,$$

where r is the coil radius, N is the number of turns, and I is the coil current. The resistance of the coil is $$R_{axial}=\frac{\rho L}{wt},$$

where ρ is the resistivity of copper, l is the total length of wire, w is the trace width, and t is the trace thickness. The inductance of the axial short solenoid coil is $$L_{axial}=0.004\pi^2 a^2 bn^2 K(\mu H),$$

where a is the coil radius, b is the coil length, n is the turn density, K is a factor that takes account of the end effects. The above properties of the coil, including magnetic moment M, resistance R, inductance L, and capacitance C, are well controlled and infinitesimally variable for printed circuits. Coils per layer are easily wired in series or parallel to further control the Q of the circuit. Circuit board construction also removes undesired off-axis magnetic moments due to wiring. Furthermore, the use of a printed circuit production process improves the reproducibility of the coil and eliminates possible human errors in construction.

The magnetic moment of an elliptic or tilted coil is defined as $$M_{tilted}=\pi a^2 \sin(\theta)NI,$$

where a is minor radius, θ is the tilted angle off the vertical axis, N is the number of turns and l is the current. The inductance of a short tilted coil is defined as $$L_{wired}=0.002l\left[\ln\left(\frac{2l}{p}\right)-\left(2\ln\left(\frac{l}{\sqrt{S}}\right)+\phi\right)+\frac{1}{4}\right]N,$$

where l is the perimeter, ρ is the wire radius, S is the area enclosed by the ellipse ($\pi a^2 \sin\theta$), and ϕ is a tabulated function of $$\frac{l}{\sqrt{S}}.$$

As with an axial coil, the variables M, R, L, and C are well controlled and infinitesimally variable for flexible circuits.

Figure 3:
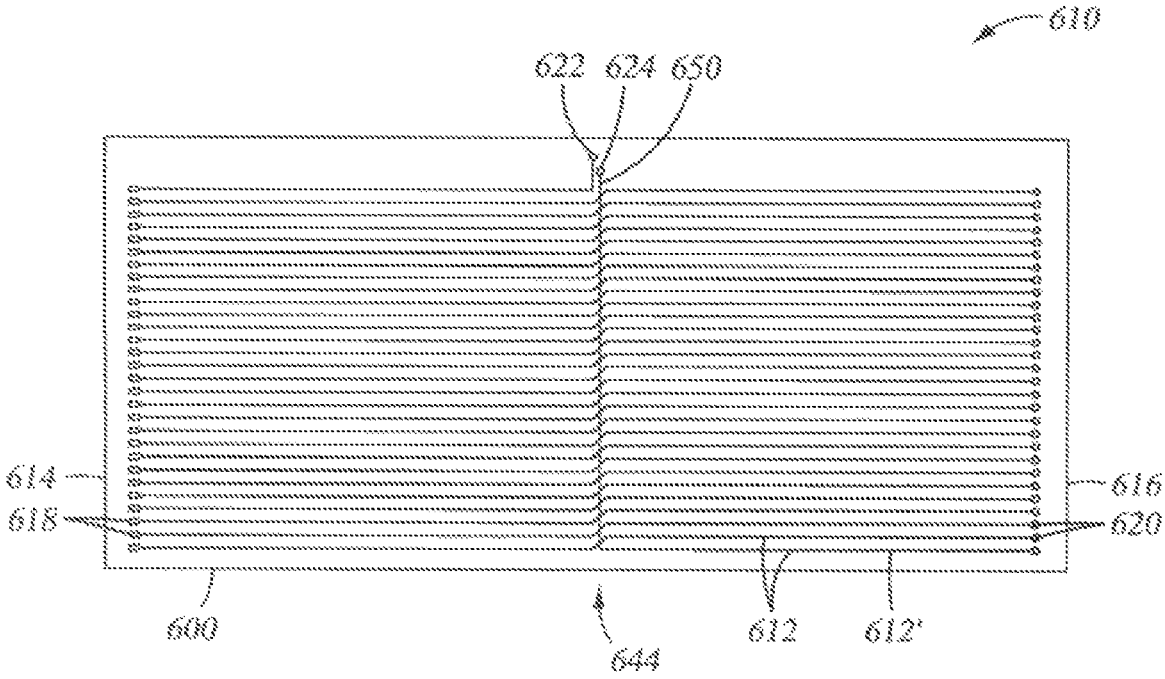
FIG. 3 is a simplified diagram of an axial coil disposed on a flexible circuit board in accordance with the present invention.

FIG. 3 depicts, in simplified form, circuit elements necessary to form an axial coil 600 (upon installation on a logging tool or other downhole equipment) according to the invention. The elements of the axial coil are permanently disposed on a flexible dielectric substrate 600. With the circuit elements secured on the substrate 600, a flexible circuit board 610 is formed in accordance with a predetermined design. The flexible circuit board 610 includes a plurality of wires or electrical conductors 612 embedded, printed, or otherwise secured on the substrate 600. In the embodiment of FIG. 3, the electrical conductors 612 may be disposed in parallel relation and may be spaced equally apart. The electrical conductors 612 are preferably copper traces that extend from a first edge 614 of the substrate 600 to a second edge 616 of the substrate 600. In a preferred embodiment, the copper trace includes a first end provided by a solder pad 618 and a second end provided by a plated through hole 620. The flexible circuit board 610 further includes input and output leads 622, 624 respectively.

More preferably, the input lead 622 and output lead 624 are positioned in proximity to one another, thereby minimizing the generation of any off-axis moments. The leads 622, 624 and conductors 612 can also be laid on different board layers as shown in FIG. 3 so as to minimize the distributed magnetic moment of the coil. A return line 650 is positioned on a second or bottom layer (in the view of FIG. 3) of the board 610 and carries a current in a direction transverse to the direction of current flow in the conductors 612, and thus, serves to reduce the effect of current flow that is not in the direction of the coil. The line 650 is directed along the middle section 644, in the circuit board illustration of FIG. 3, and connects with the bottom-most conductor 612, which is disposed between line 650 and second edge 616. The other conductors 612 of the circuit board also make a jump in the vicinity of middle section 644 above or about the return line 650—from one wire to the "next" wire above (see FIG. 3), as further explained below.

In a construction process according to the present invention, electrical conductors 612 are first mounted on the flexible dielectric circuit board 610 in accordance with the predetermined design. Such a predetermined design will include specifications for the copper trace thickness, length, and spacing between copper traces. The alignment of multiple layers of circuit boards is also easily controlled and predetermined. As discussed herein, these geometric properties of the flexible circuit board 610 establish, at least partly, certain electrical properties of the coil (e.g., M, L, R, and C) and thus, partly drive the performance and operation of the coil. By controlling the geometric properties of the flexible circuit board 610, the coil may be made to perform in a preferred, predictable manner.

A variety of materials for the substrate may be used in temperatures ranging from −25C to 200C. Materials may also be selected which have been qualified for the expected downhole or other operating conditions. Materials may be selected, for example, from those that have been qualified for expected high temperatures and pressures, and the exposure to surrounding fluids.

Figure 4:
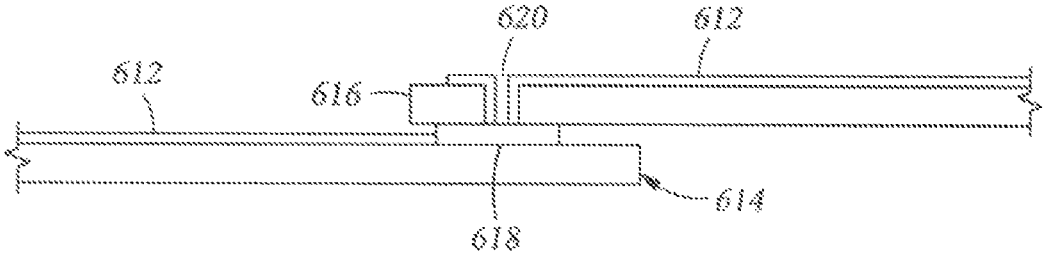
FIG. 4 is a simplified side view of the axial coil in FIG. 3 in accordance with the present invention.

Construction of the antenna further entails holding the flexible circuit board 610 against the measurement tool and thus, around the core of the tool. By "core", we mean generally a recessed region in the tool housing intended to carry an antenna, as is well known in the art. However, in certain implementations, "core" is intended to include the case in which the flexible circuit board or substrate is placed on a pad, such as that found on a resistivity imaging tool. Preferably, the tool will be equipped with a predetermined location about which the flexible circuit board 610 may be easily placed. The board 610 and tool may have alignment features to assist in the proper positioning of the board 610 relative to the tool. The first edge 614 of the flexible circuit board 610 and the second edge 616 of the flexible circuit board 610 are pressed about the circumferential surface of the tool and brought together to form a cylinder about the core. In bringing the first edge 614 and second edge 616 together, the first ends 618 and the second ends 620 of the electrical conductors 612 are also brought close together. With reference to FIG. 4, the first edge 614 is brought to overlap the second edge 616 such that the soldering pads 618 and the plated through holes 620 are positioned as shown. The pads 618 may be elongated to allow for ease of fit of the flexible circuit board 610 around the tool. At the soldering pad 618 and the plated through hole 620, physical and electrical connection may be made of the first and second ends 618, 620 of each electrical conductor 612. At these junctures, each of the right bound wires in the illustration of FIG. 3 is connected to an appropriate continuation of conductor 612 at the first edge 614 of the board 610. The continuation conductor 612 then jumps to the next loop conductor 612 above it in the middle section 644 of the board. In this way, the conductors 612 or loops of the circuit board 610 are connected to form a multiturn coil circuit.

The input and output leads 622, 624 are then joined to corresponding terminals on the tool, thereby energizing the coil circuit. Thus, a continuous coil circuit is formed around the core.

As described above, the first edge 614 and second edge 616 of the flexible circuit board 610 are connected such that the electrical conductors 612 form a set of turns. Each turn is substantially a circuit disposed about the core. The wires (electrical conductors) are implemented such that each individual turn (before each jump) lies in a plane that is substantially perpendicular to a longitudinal axis of the core. The plane is generally oriented normal or about 90° relative to the longitudinal axis. The magnetic moment of the coil that is made up of these turns is, therefore, directed generally along the longitudinal axis.

Figure 5:
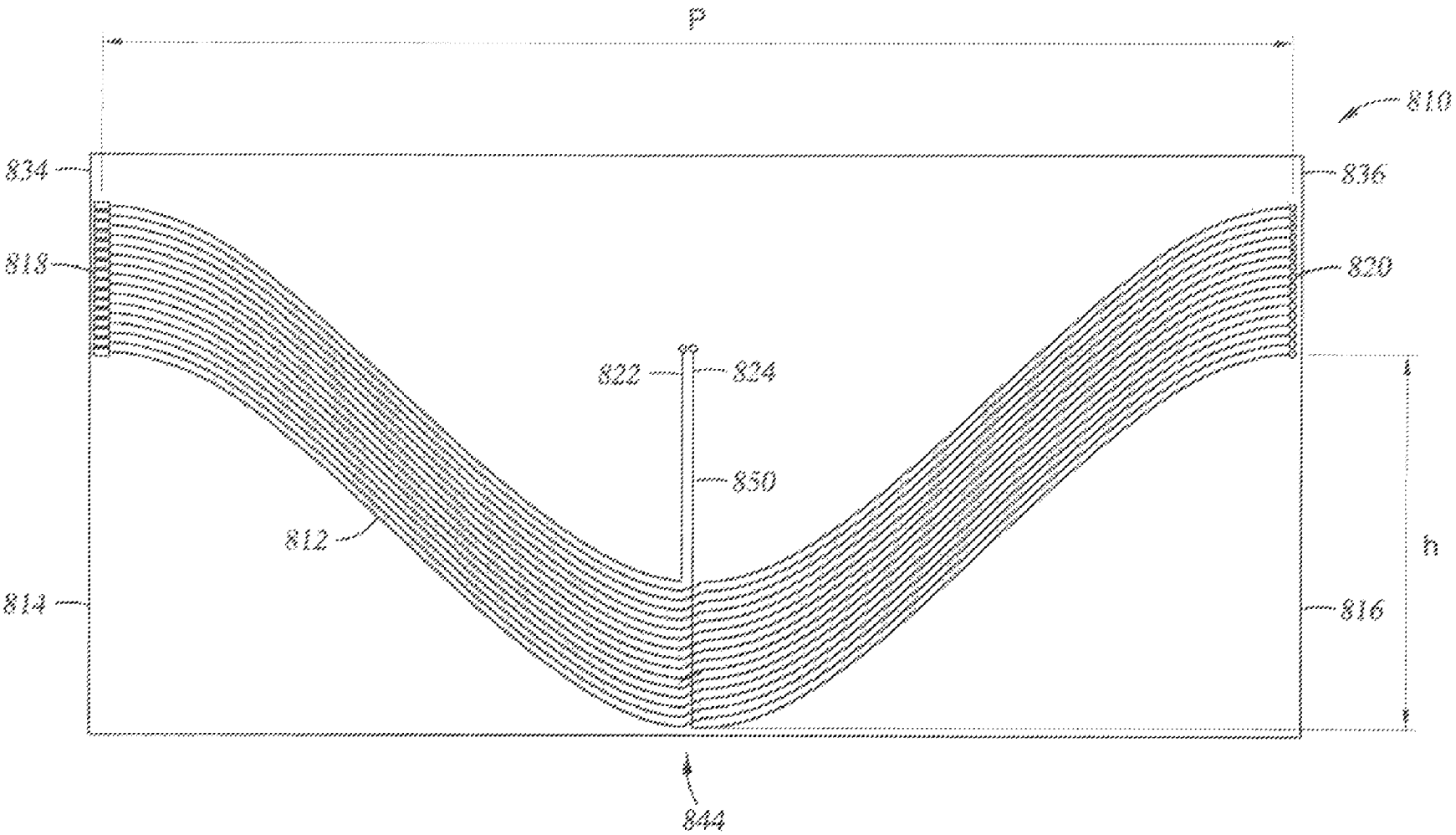
FIG. 5 is a simplified diagram of a tilted coil disposed on a flexible circuit board in accordance with the present invention.

In another aspect of the present invention, the wires on the circuit board may, in the alternative, be implemented such that each individual turn lies in a plane that is at some tilt angle relative to the longitudinal axis of the core. The turns are said to be tilted, thereby forming a tilted coil. The tilt angle may be given as $$\theta = \arctan\left(\frac{p}{\pi h}\right)$$

where p is the circumference of the tool and h is the height of the coil, as shown in FIG. 5. By adjusting those parameters, any desired tilt angle may be obtained.

FIG. 5 depicts, in a simplified form, the elements of a tilted coil disposed on a flexible circuit board 810, according to the present invention. Prior to installation about a measurement tool, the flexible circuit board 810 has a first edge 814, a second edge 816, and a plurality of electrical wires or conductors 812 extending therebetween. Each of the conductors 812 has a first end provided by a soldering pad 818 and a second end provided by a plated through hole 820. An input lead 822 and an output lead 824 are positioned in a meddle section 844 between the first and second edges 814, 816. The output lead 824 is preferably positioned in a bottom layer of the board 810, such that a return line 850 extends underneath and generally transverse to the set of conductors 812. The return line 850 carries a current that is directed transversely to the current flow in the conductors 812 and thus, functions to cancel any off-axis magnetic moments, as described above in respect to FIG. 3.

At a first edge 814, the first ends of the plurality of conductors 812 are mounted near a first corner 834 of the flexible circuit board 810. At a second edge 816, the plurality of conductors 812 is mounted near a second corner 836 of the flexible circuit board 810. The plurality of conductors 812 is mounted to curve downward from the first corner 834 to the middle section 844, wherein each conductor 812 makes a jump upward (in FIG. 5) to another wire. The conductors 812 then curve upward toward the second corner 836. In this way, each conductor 812 or set of wires traces a sinusoid across the flexible circuit board 814. The sinusoid cresta in the vicinity of the first and second corners 834, 836 and ebbs in the middle section 844.

In the construction of a tilted coil and antenna according to the present invention, the first edge 814 and the second edge 816 of the flexible circuit board 810 are brought together around a core to form a cylinder around the core. Each conductor 812 in FIG. 5 is connected with the appropriate adjacent conductor 812. In this way, the plurality of conductors 812 forms a multiturn coil about the core, with each wire of the plurality of wires representing a turn of the coil. In this embodiment, the coil is tilted with respect to a longitudinal axis of the core. The coil is, therefore, capable of directing an electromagnetic signal into a stratum of the earth at an angle oblique to the longitudinal axis of the core.

The embodiments of FIGS. 3 and 5 may be made to have many layers of coils in parallel or in series as required. By placing the coil layers in parallel or in series, the Q of the coil or its self-resonance may be varied. This provides another means of predetermining and controlling the properties and performance of the antenna.

In further embodiments, the plurality of conductors 812 may form multiple sinusoids to produce multiple coils. For example, multiple sets of wires may be implemented, within the plane of the flexible circuit board, to form multiple sets of sinusoids. When the flexible circuit board is flexed to form a cylinder around the core, each set forms a coil having a magnetic dipole moment at an angle relative to the longitudinal axis of the core.

As shown in the equation above, the tilt angle of a coil is related to the height of the sinusoid. Consider the case of two sets of sinusoids in which the height of one set is greater than the height of the other set, and the sinusoids peak at the same relative position. That is, the amplitude of one set of sinusoids is greater than the amplitude of the other, and the sinusoids are in phase. The tilt angles of the two coils resulting from those sets of sinusoids are different, but the coils have the same azimuthal orientation. In contrast, consider the ease in which the heights of the two sets of sinusoids are the same, but the sinusoids are shifted relative to one another. That is, the amplitudes of the two sinusoids are equal, but their phase is different. In this case, the tilt angles of the coils are the same, but the coils have different azimuthal orientations. Thus, by controlling the amplitude and phase of the sinusoids, one can generate magnetic dipole moments having any desired tilt angles or azimuthal orientations.

Figure 6:
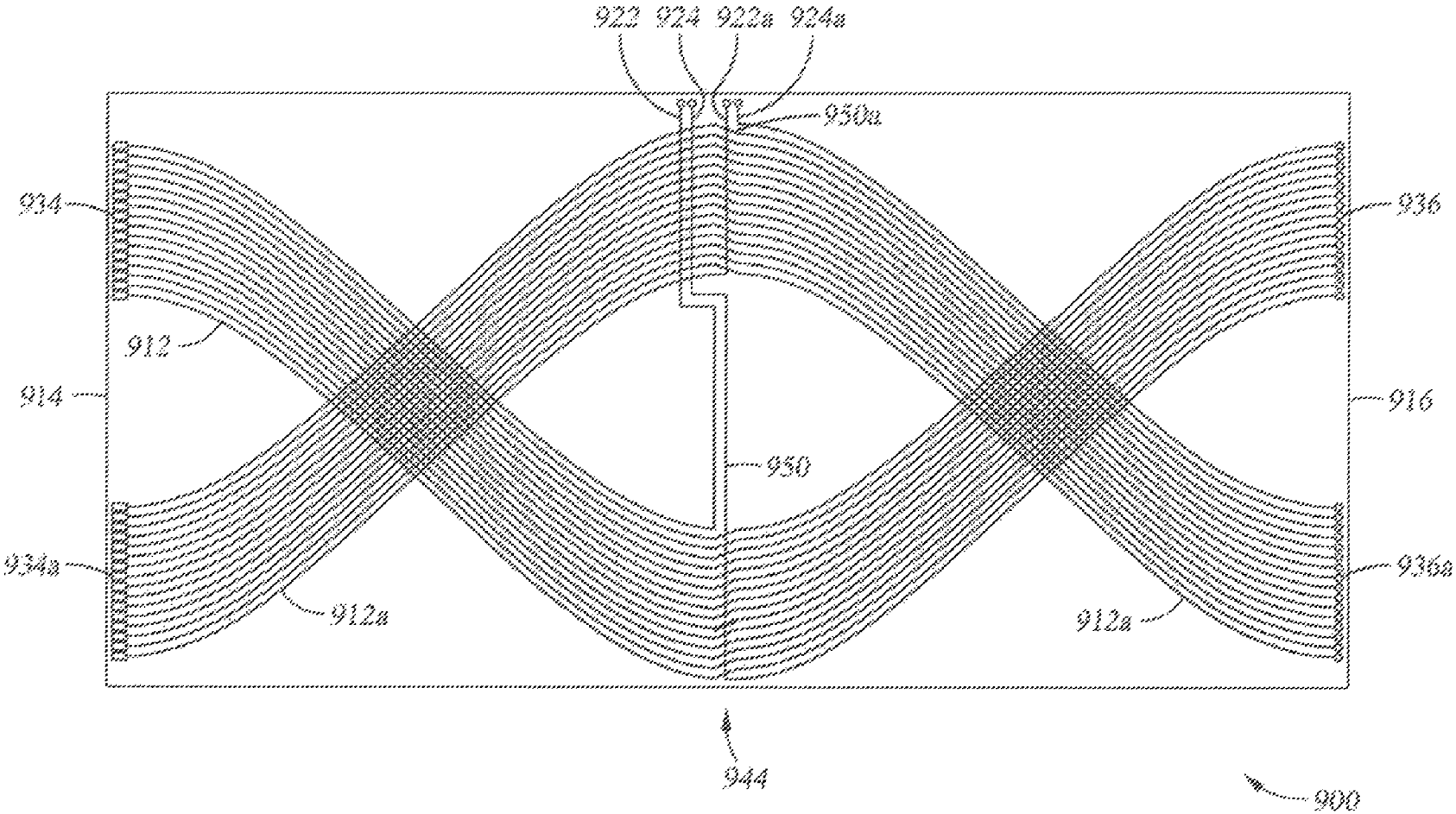
FIG. 6 is a simplified diagram of a multi-layer tiled coil disposed on a flexible circuit board in accordance with the present invention.

Referring now to FIG. 6, a further embodiment of a flexible circuit board 900 is illustrated therein, in simplified form. The flexible circuit board 900 supports various circuit elements of a plurality of coils on a flexible dielectric substrate 910. The coils in this embodiment are tilted coils, although in further embodiments, one of the coils may be an axial coil. The flexible circuit board 900 includes a first set of electrical conductors or wires 912 disposed in generally parallel relation on the substrate 910. The wires 912 are equally spaced apart and disposed to trace a generally sinusoidal wave on the substrate 910 in the same manner as described above in respect to the circuit board 810 in FIG. 5. In this embodiment, input and output leads 922, 924 for the electrical conductors 912 are provide in a middle section 944 and directed towards or from a top edge of the flexible circuit board 900.

In addition, a second set of electrical conductors 912*a* are disposed on the substrate 910. The electrical conductors 912*a* are physically and electrically separate from the first set of electrical conductors 912. The electrical conductors 912*a* originate in the vicinity of a bottom left corner 934*a*, as shown in FIG. 6. The electrical conductors 912*a* terminate at an opposite bottom right corner 936*a*, as also shown in FIG. 6. The electrical conductors 912*a* are disposed to trace a sinusoidal path across the substrate 910, and in between the first edge 914 and second edge 916. As shown in FIG. 6, the two sinusoidal waves formed by the electrical conductors 912 and 912*a* crest and ebb at different places on the board 910.

Preferably, the first set of electrical conductors 912 are disposed on the first layer of the substrate 910, whereas the second set of electrical conductors 912*a* are disposed on second layer of the same flexible circuit board 900. Furthermore, the input and output leads 922, 924 are generally disposed on a third layer of the circuit board 900, whereas input and output leads 922*a*, 924*a* of the second set of electrical conductors 912*a* are disposed on a fourth layer of the flexible circuit board 900.

As with the previously described embedments, the electrical conductors 912, 912*a* are provided with soldering pads and plated through holes, which facilitate the connection of the wires 912, 912*a* in accordance with the present invention construction method. The flexible circuit board 900 is wrapped around the circumferential plane of a measurement tool and around a core, such that respective ends of the first and second sets of electrical conductors are brought together and physically and electrically connected. Upon complete installation, the flexible circuit board 900 of FIG. 6 provides a pair of tilted coils that have a +45° and a −45° tilt. As illustrated in the flat circuit board 900 of FIG. 6, the two sinusoidal traces are generally 180° apart. In operation, if the two coils are energized simultaneously, then the flexible circuit board 900 generates a magnetic moment that is the vector sum of the two separate coils.

Figure 7:
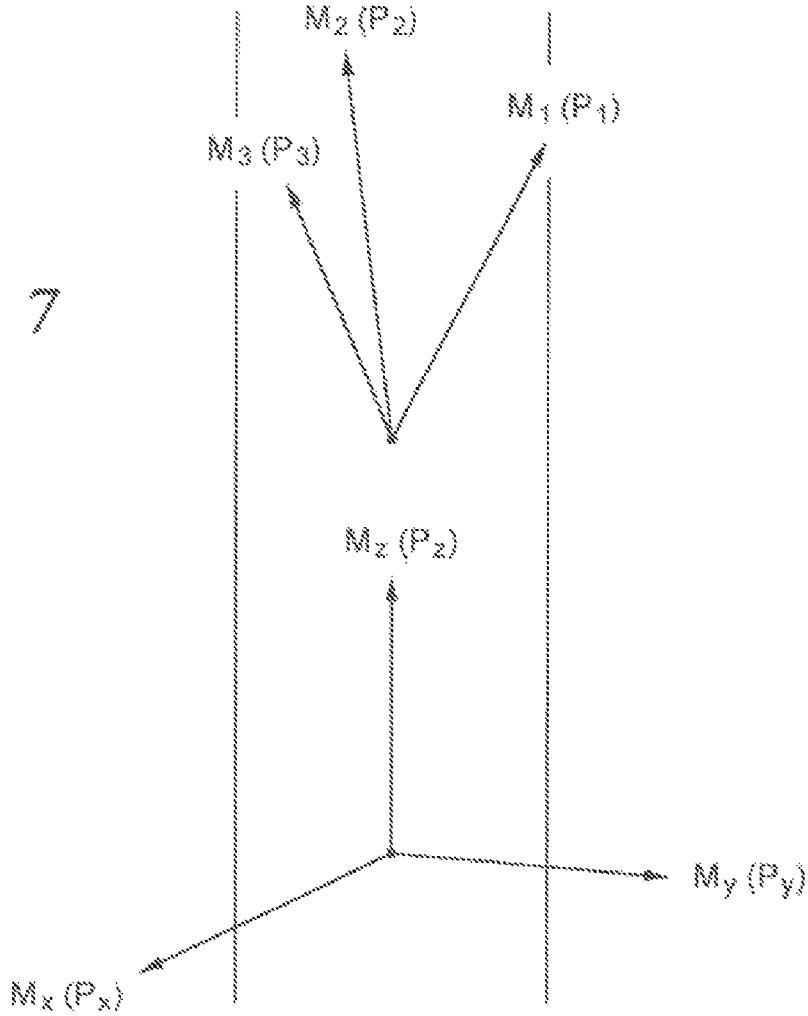
FIG. 7 is a diagrammatic representation of a set of orthogonal tilted dipoles and a set of orthogonal transverse dipoles, each disposed on a flexible circuit board in accordance with the present invention.

In a further embodiment of the invention, a flexible circuit board could be provided having three separate tilted coils thereon. As described above, the tilt angle of each coil may be independent from the others. A preferred embodiment is one in which the coils are orthogonal. This may be achieved if the coils are tilted by an angle of 54.7° with respect to the Z-axis and rotated 120° azimuthally. That is, the three sinusoids comprising the three coils are equal in amplitude and have a phase shift of 120° relative to each other. FIG. 7 illustrates in a simplified, representative form, the magnetic moments $M_1$, $M_2$, and $M_3$ generated by such an arrangement of three tilted coils about a core. In this way, an orthogonal set of co-located tilted coils for an antenna may be provided on a wireline, MWD, or other measurement tool 1000, according to the present invention.

A magnetic material can be disposed within the substrate or otherwise disposed within the interior of the coil to enhance the inductance of the coil. Multiple layers may also be laid down using different angles.

Figure 8:
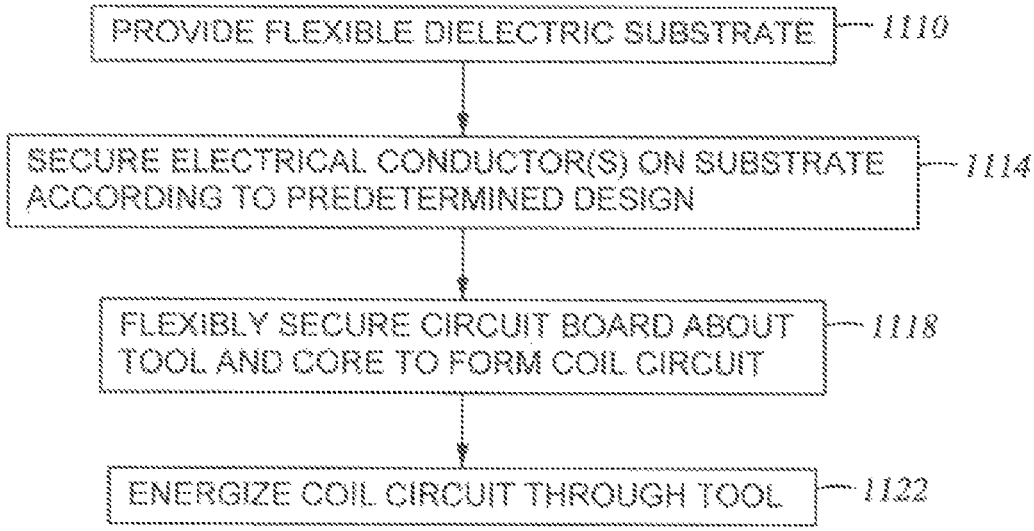
FIG. 8 is a simplified flow chart illustrating a process of constructing a flexible coil in accordance with the present invention.

As illustrated in the above description of exemplary embodiments, a construction method according to the present invention may be employed to provide an advantageous axial or titled coil, or antenna. Among other benefits, the method provides an axial or tilted coil construction that, in view of conventional constructions, is reliable, reproducible, and electrostatically controlled. The inventive construction also generates minimal off-axis magnetic moments. FIG. 8 summarizes, in a flow chart 1100, basic steps or stages of the method of construction according to the invention.

In a first step 1110 of the construction method, a flexible dielectric substrate is provided. A material for the substrate may be selected from various suitable materials that will facilitate the construction of a flexible circuit board and/or enhance the operation of the antenna in the target environment. In the subsequent step 1114, electrical conductors are secured on the substrate in accordance with a predetermined design. Such a predetermined design may include specifications for wire spacing, wire thickness, and wire length. Furthermore, the geometry of the flexible circuit board may be specified, as well as the number and arrangement of board layers. As discussed above, control of these design factors determines the properties of the coil and antenna, and its performance in the target environment. With the electrical conductor secured on the substrate, a flexible circuit board having the elements of an axial or tilted coil is provided.

In a subsequent step 1118, the circuit board is flexibly secured about a tool having a core. The electrical conductors and other leads of the circuit board are, thereby, physically and electrically connected so as to form a coil about the core. In this manner, the flexible circuit board is installed to form a coil. Depending on the predetermined design of the electrical conductors (i.e., the height and relative position of the sinusoids on the substrate), axial or tilted coils may be generated with are oriented at predetermined tilt and azimuthal angles relative to the longitudinal axis. In a further step 1122, the coil is energized by the electronics in the tool. Accordingly, the resultant antenna is made ready for measuring in a downhole operating environment or other operating environment. In the downhole operating environment, the resultant antenna may be employed in a variety of measurement techniques, including wireline, MWD, surface measuring, and other techniques for evaluating properties of a subject geological formulation.

Other embodiments of the invention may be implemented by "printing" the conductive coil(s) or elements directly onto the non-conductive core material through plating or other conventional deposition processes. One such embodiment comprises plating the entire outer diameter of the core with a conductive material and etching away the excess to form the coil. Another embodiment entails selectively plating only the shape of the coil onto the core through the use of masking techniques known in the art. Additional embodiments may also be implemented using other thin film growth techniques known in the art, such as spray coating and liquid phase epitaxy.

Several processes are known to entirely or selectively coat a dielectric material with a conductive material such as copper. These include, but are not limited to, electroless plating and the various vapor deposition processes. These techniques allow one to produce a copper (or other conductive material) overlay in the shape of a saddle coil onto a ceramic or other dielectric material core.

Electroless plating is one technique that may be used to implement the invention. This plating process enables metal coating of non-conductive materials, such as plastics, glasses and ceramics. Compared to electroplating, the coatings derived from electroless plating are usually more uniform. The deposition is carried out in liquid (solutions), and is based on chemical reactions (mainly reductions), without an external source of electric current. Electroless plating is further described in Glenn O. Mallory & Juan B. Hajdu, Electroless Plating (William Andrew Publishing, ISBN 0-8155-1277-7) (1990).

Other embodiments of the invention may be implemented using known thin film deposition techniques. Deposition is the transformation of vapors into solids, frequently used to grow solid thin film and powder materials. Deposition techniques are further described in Krishna Seshan, Handbook of Thin Film Deposition Processes and Techniques, (William Andrew Publishing, ISBN 0-8155-1442-5) (2001).

Although the electrical conductor segments described in the various embodiments above have an arcuate shape, the segments may be formed in practically any desired shape to produce, for example, coils with desired properties.

Toroid Embodiment

Figure 10:
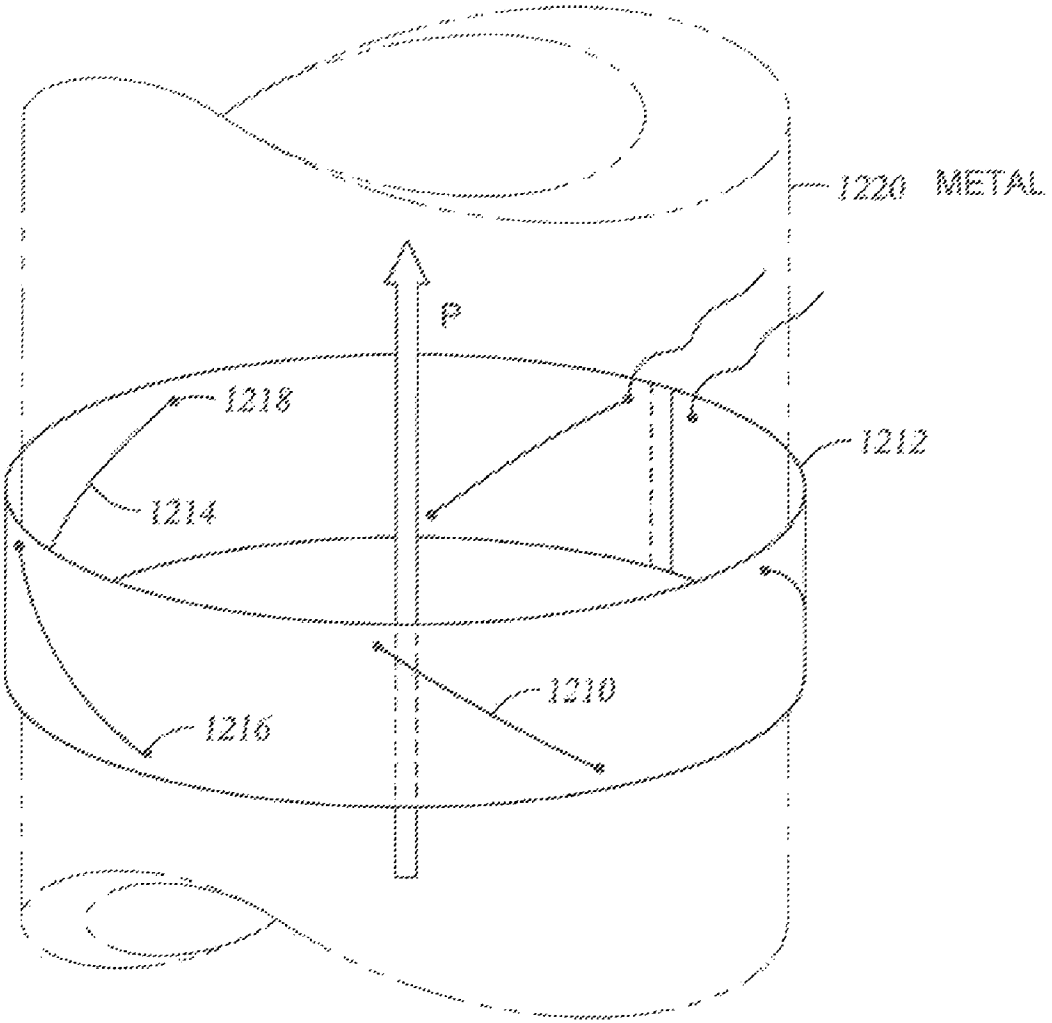
FIG. 10 is a schematic drawing of the toroid of FIG. 9 with its end closed.
Figure 9:
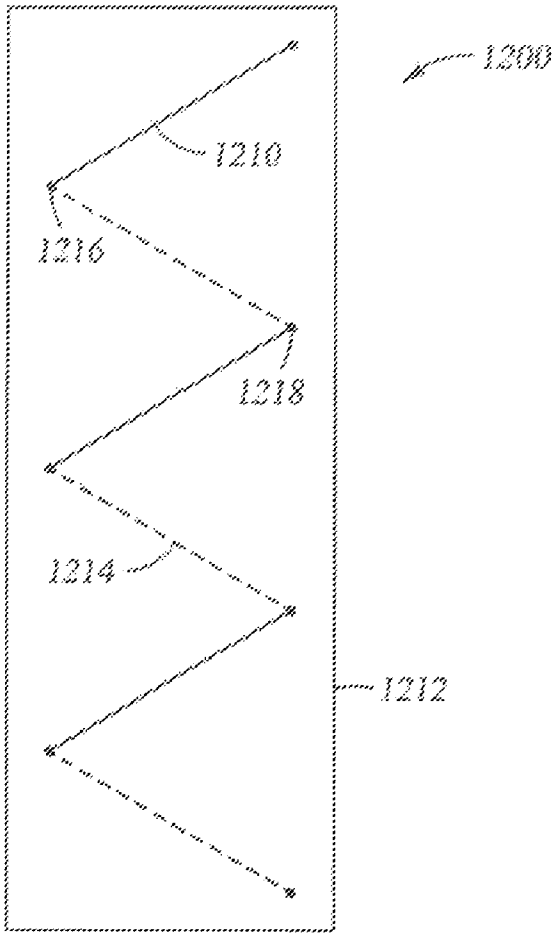
FIG. 9 is a schematic diagram of a toroid disposed on a flexible circuit board in accordance with the present invention, but with its ends opened and the toroid body lying in a plane.
Figure 15:
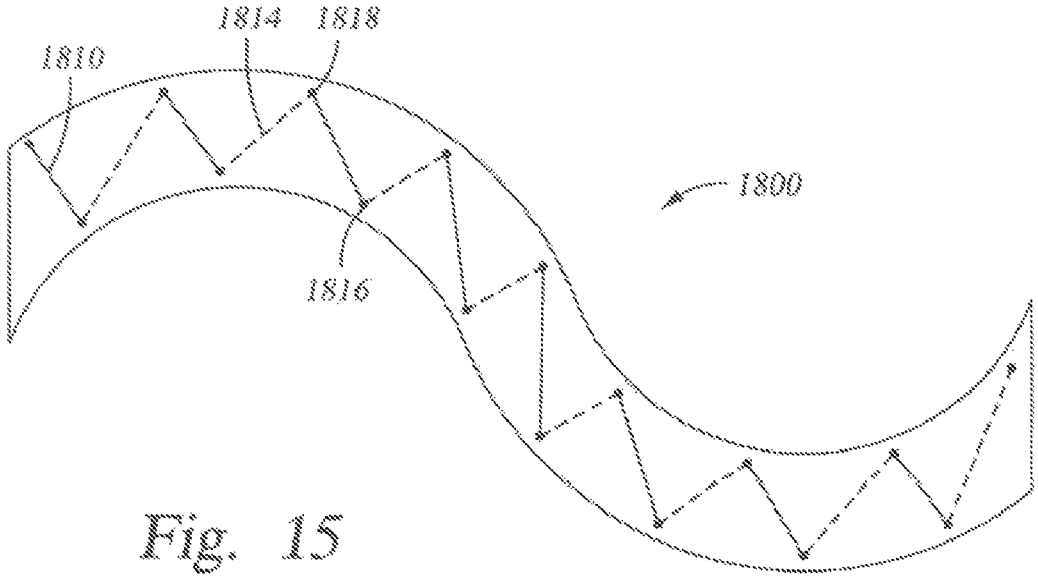
FIG. 15 is a schematic drawing of the sinusoidal pattern of a tilted toroid when the toroid is shown on a flat substrate.

The embodiment shown in FIG. 9 is that of a toroidal strip 1200. Toroids are commonly used as antennas on EM resistivity tools. Toroidal strip 1200 has a first set of conductive traces 1210, having upper 1216 and lower 1218 ends, disposed in diagonal lengths on a substrate 1212. A second set of conductive traces 1214, also having upper 1216 and lower 1218 ends, is disposed in diagonal lengths on the opposite side of substrate 1212 at an equal but opposite angle. The upper ends 1216 of the first and second sets of conductive traces 1210, 1214 are joined, and the lower ends 1218 of the first and second sets of conductive traces 1210, 1214 are joined to form a coil. The substrate 1212 can then be wrapped on a metal core 1220 to bring the substrate ends to overlap and to produce a toroid (FIG. 10). The toroid has a central plane passing though the enter of the toroid, forming a plane of symmetry. Such a toroid can be used to form a sensor or antenna for EM measurements. The toroid behaves like an electric dipole (shown as an arrow P in FIG. 10). For example, when wrapped around a mandrel, the toroid produces an electric dipole pointed along the axial direction of the tool. This is analogous to (is dual of) the magnetic dipole that will be produced by the coil formed from the traces of FIG. 3. Properly configured, one could also produce a tilted electric dipole analogous to the tilted magnetic dipole that will be produced by the traces of the coil of FIG. 5 (see FIG. 15).

In addition, if toroidal strip 1200 is very long relative to the circumference of the mandrel and wrapped around the mandrel N times, a "super toroid" having N times the inductance of a single wrap toroid can be formed. The resulting super toroid produces a much larger electric dipole moment as well.

Substrate 1212 can be a flexible printed circuit board, but preferably contains or has disposed upon it a flexible magnetic material such as magnetic tape having a high magnetic permeability. Alternatively, the conductive traces can be deposited directly on such magnetic material without a printed circuit board. When magnetic material is present in the construction of the flexible toroids, it is important to have enough overlap between the substrate ends to from a continuous ring of magnetic material.

Figure 11:
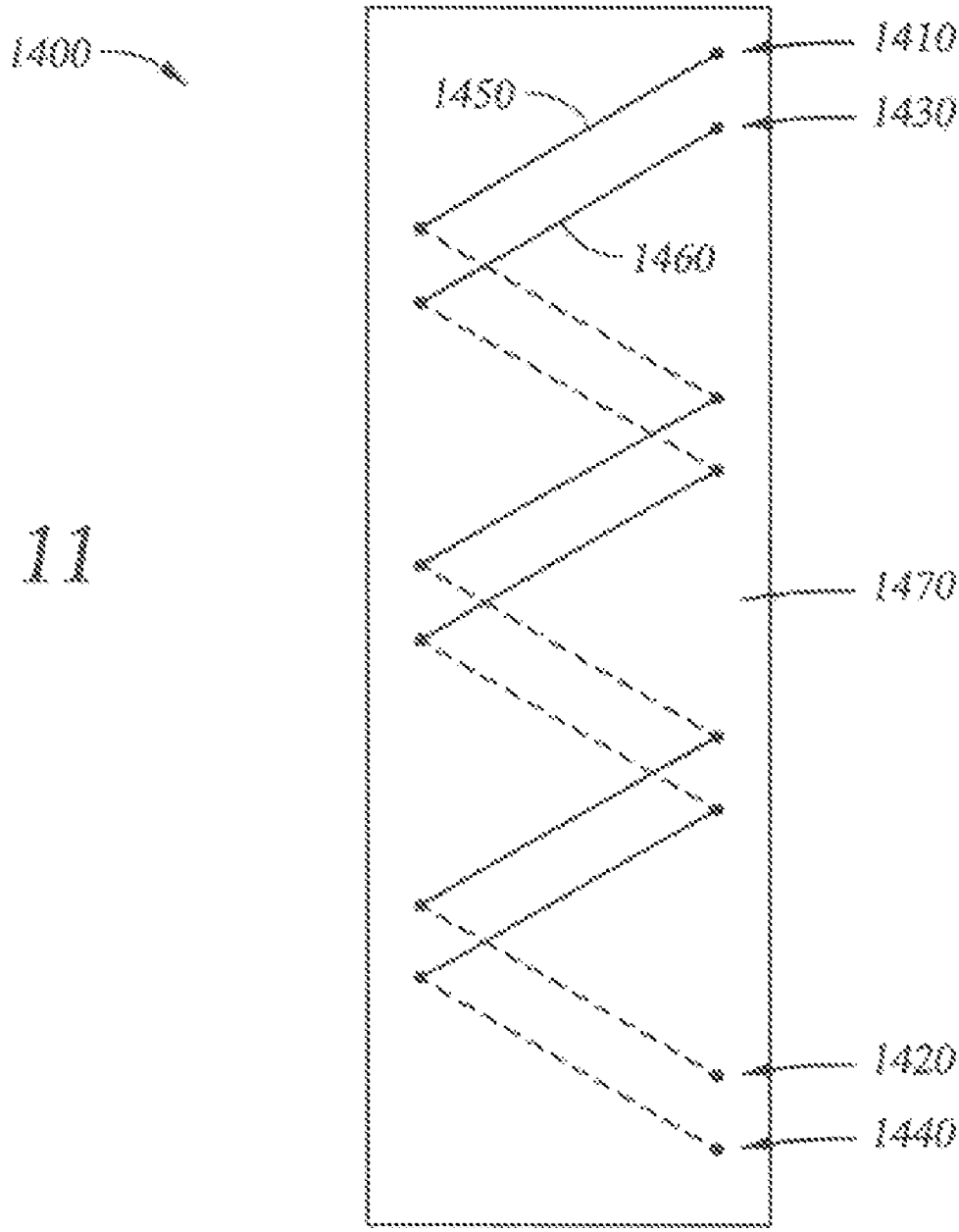
FIG. 11 is a schematic drawing of a transformer or multi-turn toroid constructed in accordance with the invention.

FIG. 11 shows an embodiment in which separated conductive traces 1450, 1460 are laid down in parallel arrangement to produce either a transformer or a multi-turn toroid, depending on how the leads 1410, 1420, 1430, and 1440 are configured. If, after wrapping substrate 1470, leads 1420 and 1430 are joined, the result is a "super toroid" having twice the number of turns than would otherwise be produced. If leads 1410 and 1420 are used as a primary coil, and leads 1430 and 1440 are used as a secondary coil, a transformer (e.g., isolation transformer of ratio 1:1) is formed. Other embodiments to produce particular desired properties are readily apparent to those of ordinary skill in the art.

Figure 12:
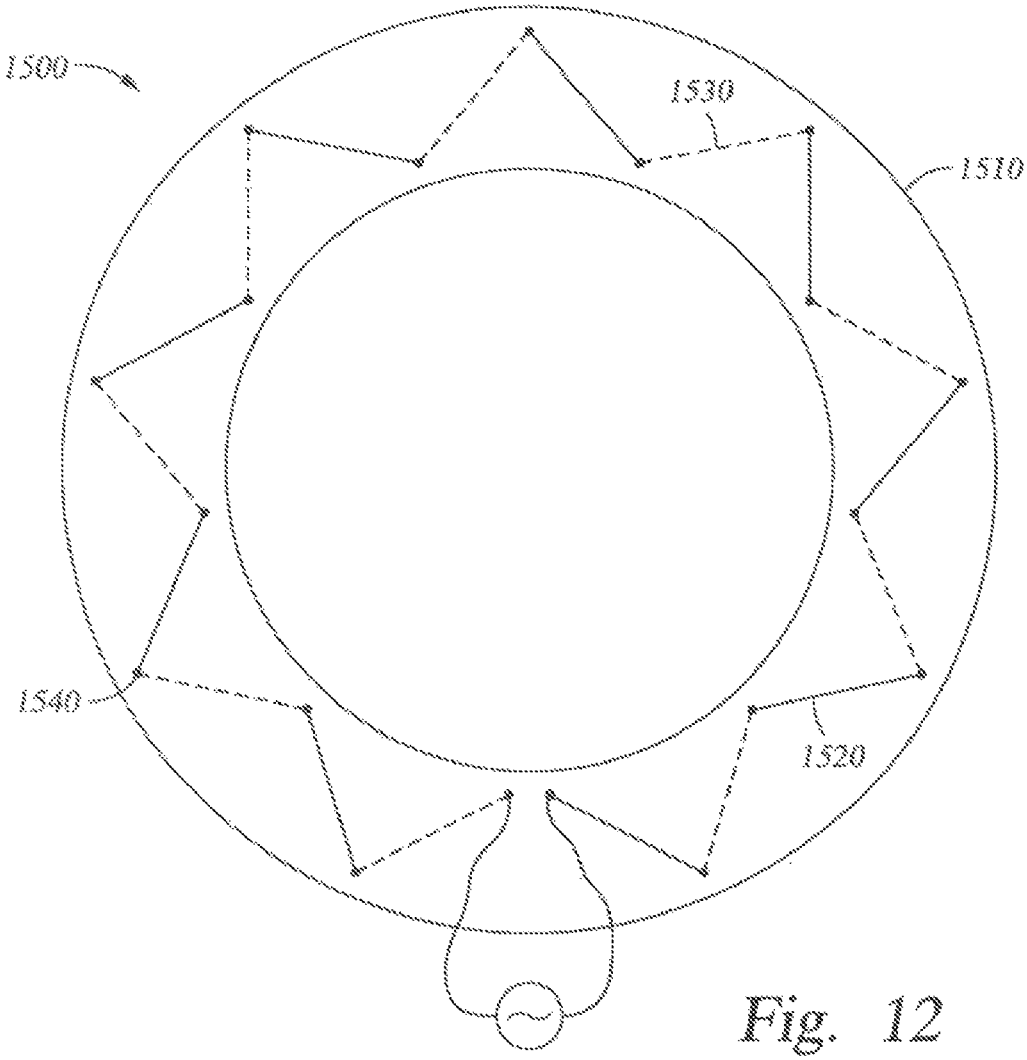
FIG. 12 is a schematic drawing of a flat toroid constructed in accordance with the invention.

FIG. 12 shows an embodiment of a flat toroid 1500 in which the substrate 1510 is shaped as an annular ring. Conductive traces 1520 are deposited on one surface of substrate 1510 and the other conductive traces 1530 are deposited on the opposite surface. Ends of the conductive traces 1520, 1530 are joined at junctions 1540. As before, substrate 1510 may contain or carry a magnetic material. Multiple turns using, for example, multiple layers or parallel traces can be produced. Also, multiple toroids can be stacked to produce a super toroid. Flat toroid 1500 can also be configured to be a transformer, analogous to that described above.

Figure 13:
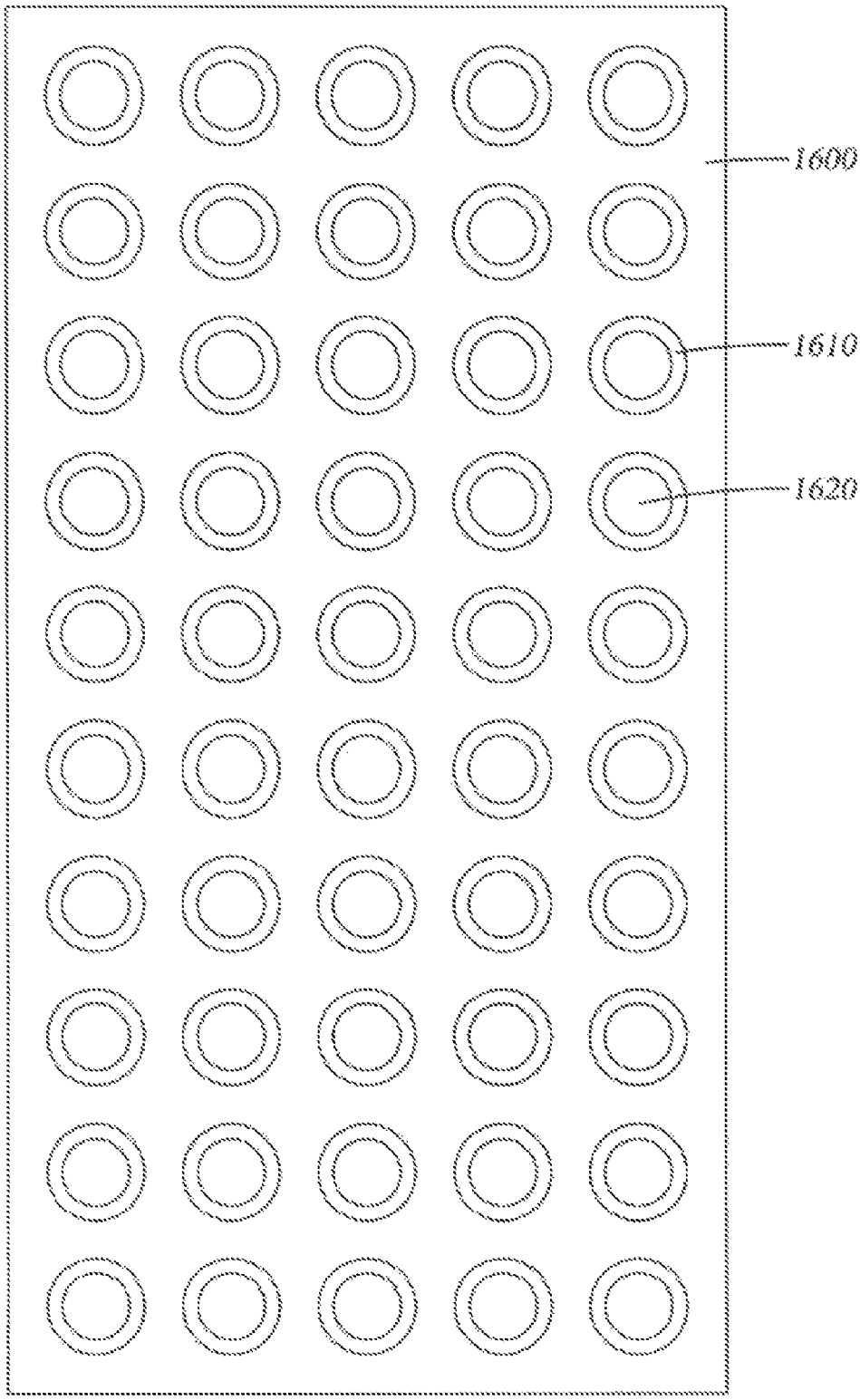
FIG. 13 is a schematic drawing showing an array of sensor buttons in constructed in accordance with the invention.

As an example, the toroids described above can be used as button sensors in a resistivitimaging tool. As shown in FIG. 13, an array of button sensors 1610 can be produced using the above described construction methods. The array can be mounted on a metal pad 1600 with metal buttons 1620. Each toroid in the array can serve to inject current into the formation and measure the voltage developed in the formation to determine the local resistivity of the formation.

Figure 14:
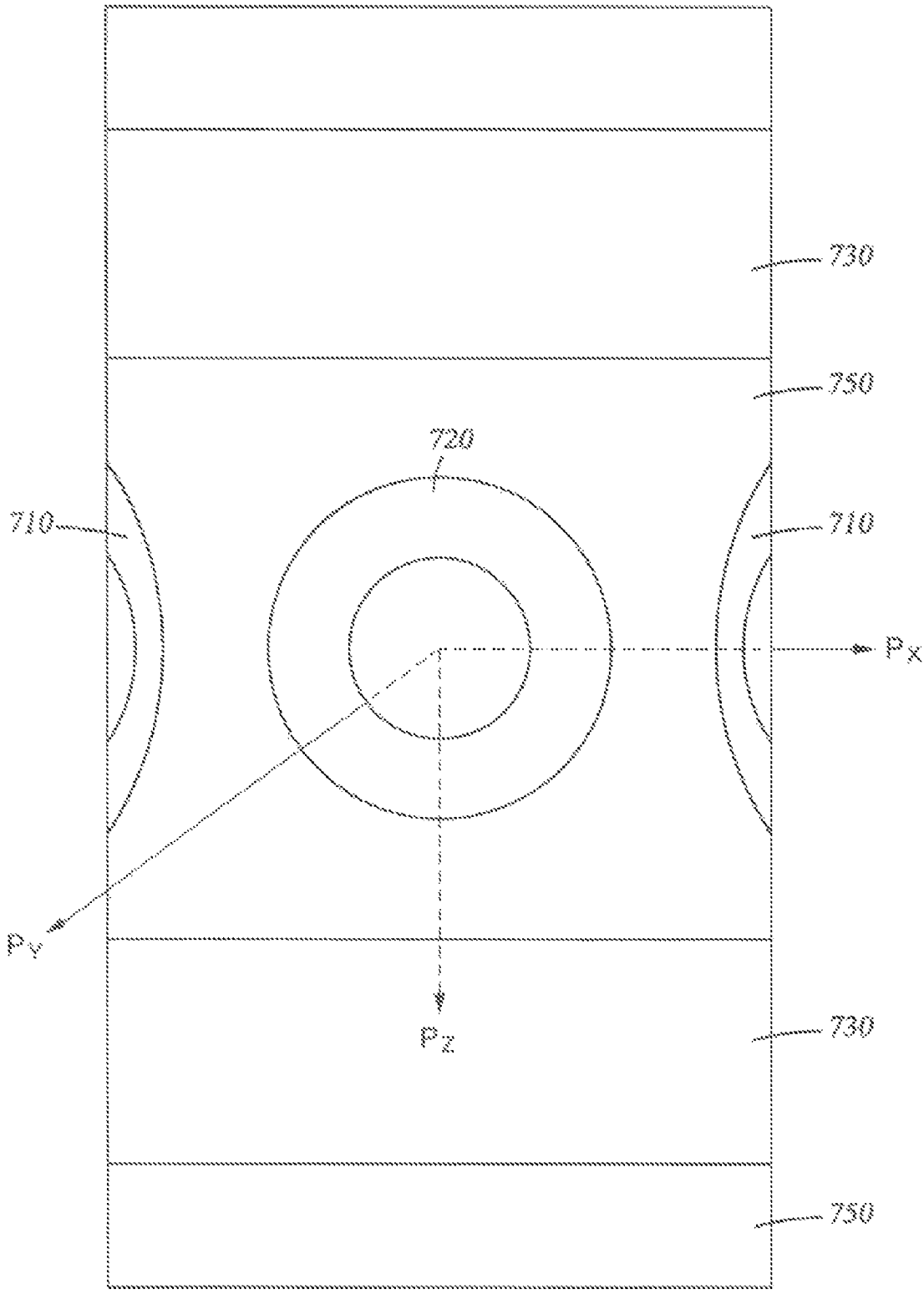
FIG. 14 is a schematic drawing showing a triaxial electric dipole tool constructed in accordance with the invention.

Alternatively, as shown in FIG. 14, the toroids can be arranged to form a triaxial electric dipole tool. Two toroids 1710 can be rotationally offset by 180° and mounted on a metal core 1750 to form one electric dipole, while two other toroids 1720 are similarly offset but rotated 90° relative to the first pair to form an electric dipole orthogonal to the first pair. Those dipoles can be constructed on a signal substrate and wrapped around the metal core 1750. Another toroid, or pair of toroids 1730, can be used to produce a longitudinally directed electric dipole orthogonal to the other two dipoles. All three of these dipoles can be co-located as shown in FIG. 14 and FIG. 7 ($P_x$, $P_y$, and $P_z$). In addition, if the toroids are tilted by an angle of 54.7° with respect to the Z-axis and rotated 120° azimuthally relative to one another, the electric moments $P_1$, $P_2$, and $P_3$ form a co-located orthogonal and tilted triaxial antenna configuration, as shown in FIG. 7.

While the invention has been described with respect to a limited number of embodiments, those skilled in the art will appreciate that other embodiments, can be devised which do not depart from the scope of the invention as disclosed herein. For example, the antennas of the invention may be configured using a combination of printed and wired coils. Multiple overlaid substrates may also be used to achieve modified couplings or to alter the magnetic moment(s) as desired. Using multiple-layered substrates would allow for antennas to be collated on the support, e.g., a bucking and a receiver antenna. It will also be appreciated that the embodiments of the invention are not limited to any particular material for their construction. Any suitable material or compounds (presently known or developed in the future) may be used to form the embodiments of the invention provided they allow for operation as described herein.

What is claimed is:

1. An antenna for an electromagnetic tool used in a wellbore, the tool having a core with a longitudinal axis, the antenna comprising:

a flexible dielectric substrate conformed about the core; and a set of electrical conductor segments disposed on the substrate, the electrical conductor segments having first ends and second ends such that the first ends are electrically joined to the second ends to form a multiturn coil, whereby one of the first ends is electrically connected to a first lead, and one of the second ends is electrically connected to a second lead, wherein the electrical conductor segments are disposed in multiple layers to form a multilayered, multiturn coil.

2. The antenna of claim 1 wherein the substrate is, contains, or has disposed upon the substrate a flexible magnetic material.

3. The antenna of claim 1, wherein the electrical conductor segments extend in a generally sinusoidal pattern on the dielectric substrate.

4. The antenna of claim 1, wherein the coil is tilted relative to the longitudinal axis.

* * * * *